US006053719A

United States Patent [19]

Barbier et al.

[11] Patent Number: 6,053,719

[45] Date of Patent: Apr. 25, 2000

[54] APPARATUS FOR THE MANUFACTURE OF A SPUN NONWOVEN FABRIC

[75] Inventors: Detlef Barbier, Waldfischbach-Burgalben; Engelbert Löcher, Worms; Ararad Emirze, Kaiserslautern; Norbert Goffing, Neunkirchen, all of Germany

[73] Assignee: Firma Carl Freudenberg, Weinheim, Germany

[21] Appl. No.: 08/902,446

[22] Filed: Jul. 29, 1997

[30] Foreign Application Priority Data

Jul. 29, 1996 [DE] Germany ..... 196 30 523

[51] Int. Cl.[7] ..... D01D 5/30

[52] U.S. Cl. ..... 425/81.1; 425/72.2; 425/83.1; 425/131.5; 425/463

[58] Field of Search ..... 425/131.5, 81.1, 425/66, 83.1, 72.2, 382.2, 462, 463

[56] References Cited

U.S. PATENT DOCUMENTS

| | | | |
|---|---|---|---|
| 2,732,885 | 1/1956 | Van Der Hoven | 425/81.1 |
| 2,801,673 | 8/1957 | Welsh | 425/81.1 |
| 2,996,102 | 8/1961 | Schuller | 425/83.1 |
| 3,200,440 | 8/1965 | Bryan et al. | 425/131.5 |
| 3,802,817 | 4/1974 | Matsuki et al. | 425/83.1 |
| 4,999,080 | 3/1991 | Boich | 425/83.1 |
| 5,039,431 | 8/1991 | Johnson et al. . | |
| 5,679,042 | 10/1997 | Varona | 425/83.1 |

FOREIGN PATENT DOCUMENTS 4352861 12/1992 Japan .

*Primary Examiner*—Harold Pyon
*Assistant Examiner*—Joseph Leyson
*Attorney, Agent, or Firm*—Kenyon & Kenyon

[57] ABSTRACT

The apparatus for manufacturing the nonwoven fabric contains at least one, and may contain up to forty or more, spinneret devices, such as rectangular spinneret plates or round spinneret disks. The spinneret devices may be arranged in rows or in staggered arrangement above a linearly moving collector belt. Spinning orifices on the spinneret devices are respectively dedicated to producing a monofilament or a bicomponent filament from a melt and, viewed in the direction of motion of the collector belt, are arranged with respect to one another so as to correspond in their totality to the cross sectional structure of different filament types in the nonwoven fabric.

12 Claims, 3 Drawing Sheets

APPARATUS FOR THE MANUFACTURE OF A SPUN NONWOVEN FABRIC

FIELD OF THE INVENTION

The invention concerns a spun nonwoven fabric which has different proportions of bicomponent filaments along its cross section. The remaining filaments are polyethylene terephthalate monofilaments.

BACKGROUND OF THE INVENTION

A spun nonwoven fabric of this kind is known from JP A Patent 435 28 61, as a material for bags. The spun nonwoven fabric includes two types, A and B, of long conjugated multicomponent filaments. Filament type A comprises the polymer components (a1) and (a2), the latter having a melting point 30 degrees C. higher than (a1). Filament type B comprises the polymer components (b1) and (b2), component (b1) having a melting point 20 degrees C. higher than component (a1), and component (b2) having a melting point more than 30 degrees C. higher than component (b1).

The nonwoven fabric of JP A Patent 435 28 61 further possesses a four-layer structure in cross section, the individual layers differing in that the first contains only filaments of type A; the second layer and third layers contain filament types A and B, with a higher proportion of filament type A in the second and a higher proportion of filament type B in the third layer; while the subsequent fourth layer consists only of filaments of type B.

The different melting points on the two surfaces of the nonwoven fabric and the different melting points in the cross section of the nonwoven fabric which result from this configuration prevent delamination of the individual layers.

OBJECTS AND SUMMARY OF THE INVENTION

It is an object of the invention to provide a spun nonwoven fabric, made up of monofilaments and bicomponent filaments. Because of the different distribution of the filaments in the cross section of the nonwoven fabric, the interior of the nonwoven fabric may be configured harder or softer than at least one of its outwardfacing surfaces. The different distributions of filaments are preferably achieved through a smooth transition to thereby avoid a layered structure with distinct phase boundaries. Avoiding distinct phase boundaries reduces the risk of delamination of individual layers, for example following high-temperature treatment during dyeing and steaming, or as a result of mechanical stress, for example during shaping.

The invention further provides an apparatus suitable for manufacturing a spun nonwoven fabric of the kind described above. In the existing art, multiple process steps, proceeding separately from one another, are necessary for manufacturing and for joining the individual layers of the nonwoven fabric. Each of the steps requires a separate, adjusted arrangement of the spinneret beam. In contrast, according to the present invention, a single apparatus with correspondingly arranged spinneret beams is sufficient for manufacturing the spun nonwoven fabric. This arrangement is similar to conventional apparatuses for manufacturing monofilaments.

It is an object of the present invention to provide a spun nonwoven fabric comprising monofilaments made of polyethylene terephthalate and bicomponent filaments made of polyethylene terephthalate and a polymeric binding component. The bicomponent filaments may have at least two outward-facing segments of the binding component. The bicomponent filaments, taken over cross sectional planes of the spun nonwoven fabric, are present in different weight proportions having a range from approximately 1% by weight to 100% by weight. The cross sectional planes of the spun nonwoven fabric, which have different proportions of bicomponent filaments, transition into one another without detectable phase boundaries.

It is a further object of the invention to provide an apparatus for manufacturing a spun nonwoven fabric comprising at least one spinneret device having a plurality of spinning orifices, the at least one spinneret device arranged above a stretching device adapted to receive filaments leaving the plurality of spinning orifices, and a transport device located beneath the stretching device for receiving the filaments, the transport device having a horizontally and linearly moving collector belt defining a transport direction. The plurality of spinning orifices of the at least one spinneret device face toward the collector belt. At least a first portion of the plurality of spinning orifices discharge a monofilament from a melt, and at least a second portion of the plurality of spinning orifices discharge a bicomponent filament from respective melts, such that when viewed in a direction of motion of the collector belt a projection of the plurality of spinning orifices onto the plane of the collector belt corresponds to the concentration profile of the filaments in a vertical cross section of the nonwoven fabric. Viewed in the direction of motion of the collector belt, the filaments which impact the collector belt first are the filaments intended to constitute an outward-facing surface of the nonwoven fabric. Then, in continuous transition from the filaments deposited first, the filaments constituting inner regions of the nonwoven fabric are deposited. Finally, and in the same way, the filaments constituting a second outward facing surface of the nonwoven fabric are deposited in continuous transition from the filaments deposited before them. The filaments constituting any given cross section of the spun nonwoven fabric may include monofilaments, bicomponent filaments, or a mixture thereof.

DETAILED DESCRIPTION OF THE DRAWINGS

Figure 1A:
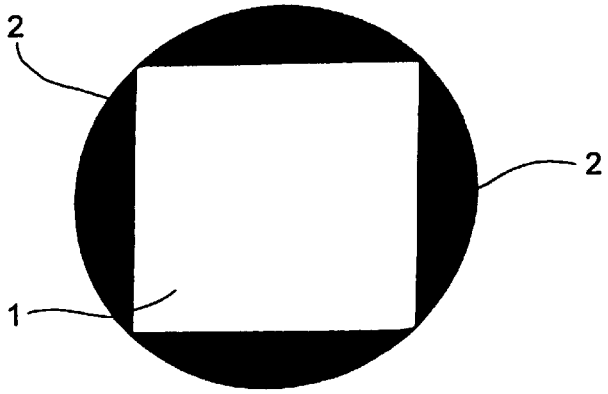
FIGS. 1*a*–1*c* show possible cross sections of the bicomponent filaments.
Figure 1B:
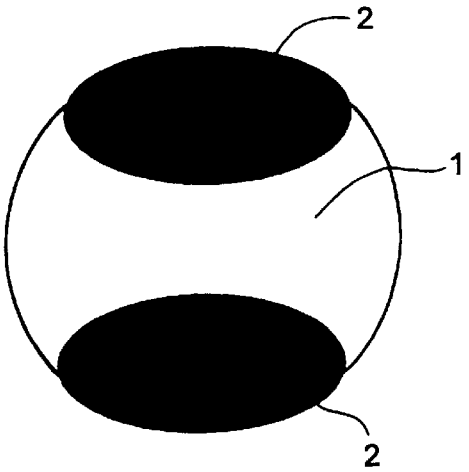
Figure 1C:
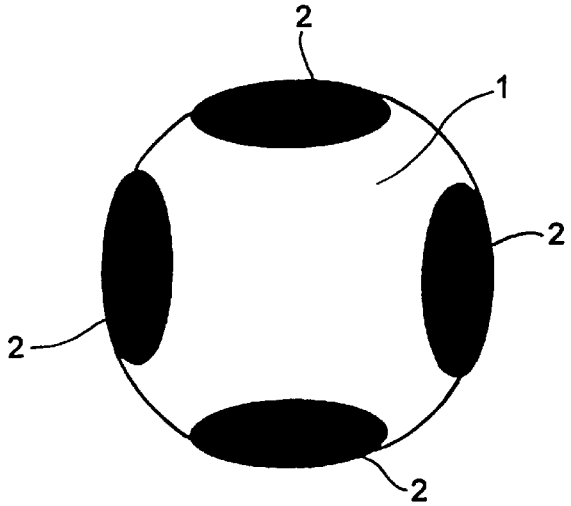

FIGS. 1*a*–1*c* show cross sections of three embodiments of bicomponent filaments that can be used according to the invention. Filament matrix 1 may be made of polyethylene terephthalate. The outward-facing segments 2 may be made of a binding component. Filaments with cross sections of this kind, and the spinning thereof from respective melts through orifices, are known in the art and are not subjects of the invention. The term "segments" is to be understood here as a regularly or irregularly shaped concentration of the binding component on the outer surface of a polyethylene terephthalate core filament which may have any cross sectional configuration.

Examples of adherent or binding components include, among others, copolymers of terephthalic acid or dimethyl terephthalate, isophthalic acid, adipic acid, ethylene glycol, or butanediol, and homopolymers such as polybutylene terephthalate, polyamides, and polyolefins of the homologous series from polyethylene through polybutylene.

The invention concerns a spun nonwoven fabric which consists of monofilaments and bicomponent filaments and which has different proportions of the bicomponent filaments over its cross section. The proportions of the bicomponent filaments are between approximately 1% and 100% by weight in terms of the bicomponent filaments' proportionate weight in the particular selected cross sectional plane of the nonwoven fabric.

The monofilaments, which are optionally present, may be made of polyethylene terephthalate. The bicomponent filaments may be made of a core 1 of polyethylene terephthalate with outward-facing segments 2, which may be made of the binding component. Preferably, in accordance with the invention, the cross sectional planes of the spun nonwoven fabric transition smoothly into one another in terms of the proportions of bicomponent filaments such that no detectable phase boundaries exist. Therefore, delamination of adjacent nonwoven fabric layers with different filament compositions is essentially eliminated.

According to the present invention, one may create spun nonwoven fabrics of various weights per unit area, having various mixtures of monofilaments and bicomponent filaments in the individual cross sectional planes. For example, spun nonwoven fabrics having weights per unit area in a range between, for example, approximately 10 and 500 g/m$^2$ may be produced as desired.

The desired application of the nonwoven fabric may govern the proportions of filaments used. Generally low proportions of bicomponent filaments lead to softer and more flexible nonwoven fabric surfaces. When bicomponent filaments are present in higher proportions, up to and including, for example, when they are present exclusively, internal stability of the nonwoven fabric section is achieved, which makes the section suitable for support and stabilization of the entire nonwoven fabric structure. Nonwoven fabric layers with relatively higher proportions of bicomponent filaments may also provide a barrier function against the penetration of fluid media, which is significant for filter applications.

In one embodiment of the present invention, a first outward-facing surface of the spun nonwoven fabric possesses a higher proportion of bicomponent filaments than the opposite outward facing surface. The first outward facing surface is thus hard and heat-bondable. The opposite surface, having a lower proportion of bicomponent filaments, is softer and does not possess heat-bonding properties.

The heat-bonding capability of spun nonwoven fabrics having high proportions of bicomponent filaments is a further advantage of the present invention, and may be important, for example, in textile applications, such as for stiffening linings. The cross section of a nonwoven fabric of this kind may exhibit a constant gradient in the percentage proportion of bicomponent filaments, and thus in the hardness from one surface to the other.

A further application for embodiments of the present invention having hard surfaces, in which the hard surface of the nonwoven fabric contains 80 to 100% bicomponent filaments, concerns the manufacture of tufted carpets. For example, when carpets of this kind are foam-coated, the gradient in the direction of the hard, bicomponent fiber-rich surface prevents the coating compound from penetrating through the soft flat side to the pile fibers. This gradient thus also indirectly controls the tear resistance of the finished carpet. The high-volume, soft side of the nonwoven fabric, on the other hand, promotes good nap formation, and thus promotes anchoring of the carpet fibers in the cross section of the nonwoven fabric during tufting. The tufting needles can still penetrate from the hard side into the nonwoven fabric without having fibers detach from it and catch in the needles which would disrupt the tuft pattern.

Another advantage in applying the present invention to tufted carpets is that it is possible to work with low carpet fiber weights (i.e. low pile weights) and low carpet fiber lengths (i.e. low pile heights) without causing any change in the surface pattern (i.e. pile pattern) due to fibers detached from the nonwoven fabric structure.

Another embodiment of the present invention provides a spun nonwoven fabric having two soft outer surfaces and relatively harder inner cross sectional regions. The outer soft surfaces have relatively few bicomponent filaments while the harder inner cross sectional regions have a relatively larger proportion of bicomponent filaments.

A further embodiment of the present invention provides a spun nonwoven fabric in which the two outward-facing surfaces each have a high proportion of bicomponent filaments and thus have a hard consistency, while the inner cross sectional regions have lower proportions of bicomponent filaments, and are thus softer than the outward facing surfaces.

For each of the latter embodiments, the two outer surfaces of a given embodiment are substantially similar to one another. Thus, according to the present invention, it is possible to manufacture planar structures which, in the case of the low proportions of bicomponent filaments in the outer region, have a very textile-like feel on both sides. Alternatively, it is possible to manufacture planar structures which have high proportions of bicomponent filaments in the region of the outer surfaces and thus have hard outer surfaces and a soft inner core, having a large volume with high air permeability. This property is useful, for example, for air filters, the outer surfaces of which must alone contribute to the load-bearing capability and strength. It is also advantageous, in the manufacture of such filters, if despite the softness of the material, no fibers detached from the structure are produced as it is being processed.

The invention also provides an apparatus for manufacturing the spun nonwoven fabric described above.

Referring to FIGS. 2*a*, 2*b* and 3*a*–3*d*, this apparatus has one or more, including, for example, up to forty or more, spinneret devices such as rectangular spinneret plates 3, round spinneret disks 4, or a combination thereof, which may be arranged above a conventional stretching device (not shown) for the filaments leaving spinning orifices 5, 6. Beneath the stretching device, the spun filaments drop onto a transport device, which includes a collector belt 7, moving, for example, horizontally and linearly. The filaments impact and are deposited onto the collector belt 7 to form the spun nonwoven fabric.

Spinning orifices 6 discharge the monofilaments, and spinning orifices 5 discharge the bicomponent filaments, in each case from respective melts thereof. Both types of spinning orifice 5, 6 may be present on each spinneret plate 3 or spinneret disk 4.

The spinneret orifices 5, 6 have a planar distribution such that, viewed in the direction of travel of collector belt 7, the sequence in which the two filament types (i.e. the monofilaments of polyethylene terephthalate and the bicomponent filaments) impact onto the moving collector belt 7 occurs in a predefined temporal sequence that is linear with respect to the surface of collector belt 7. The apparatus is configured so that, in its totality, the projection onto the plane of collector belt 7 of all spinning orifices 5, 6 of spinneret plates 3 or spinneret disks 4 that are used corresponds to the concentration profile of the filament mixture in the vertical cross section of the nonwoven fabric. Thus, viewed in the direction of motion of collector belt 7, the filaments or filament mixtures which arrive first are those intended to constitute one of the externally located surfaces of the nonwoven fabric being manufactured. A continuous transition occurs from the first type or mixture of filaments deposited to the succeeding filaments or filament mixtures deposited, which constitute the inner regions of the nonwoven fabric. Finally, the last filaments impacting onto collector belt 7 are deposited, which constitute the second surface of the spun nonwoven fabric.

Figure 3A:
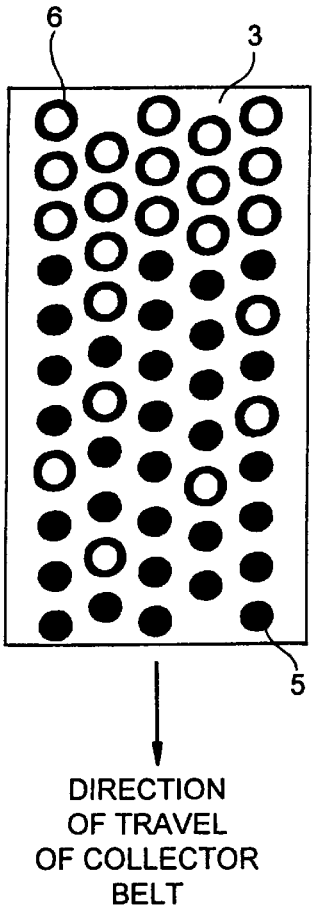
FIGS. 3*a*–3*d* show different variants of spinning orifice arrangements on rectangular spinneret plates.
Figure 3B:
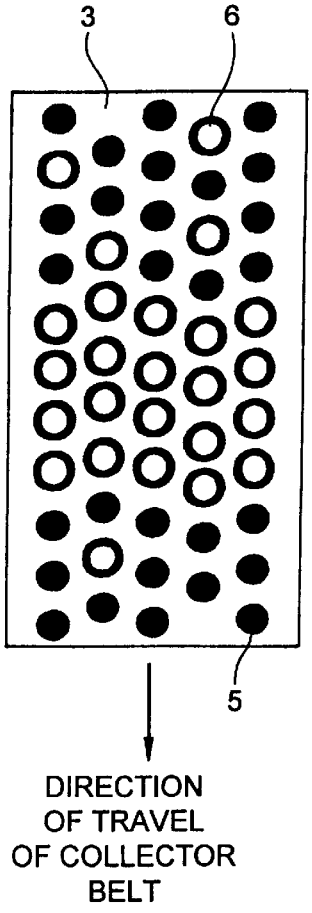
Figure 3C:
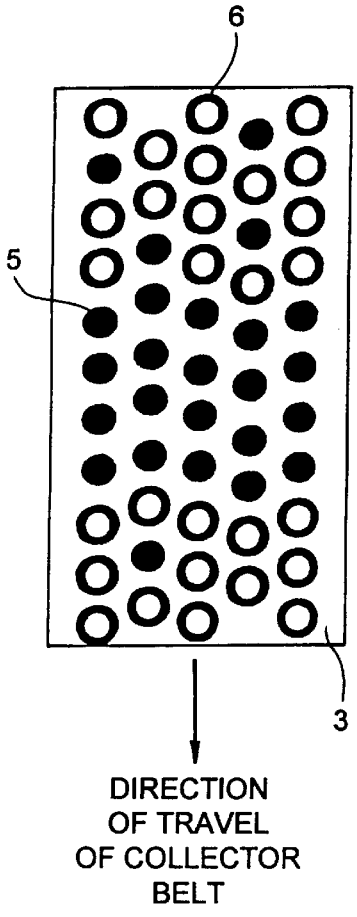

FIGS. 3*a*–3*c* shows half three rectangular spinneret plates 3 arranged with their long axes parallel to the direction of travel of collector belt 7. The arrangement of spinning orifices 5, 6 on spinneret plate 3 shown in FIG. 3*a*, for example, leads to a spun nonwoven fabric whose surface that is deposited first on collector belt 7 is very soft and contains exclusively monofilaments from spinning orifices 6. As deposition continues, this surface, which faces collector belt 7, is covered with increasingly higher proportions of bicomponent filaments from spinning orifices 5. Finally, the other surface of the nonwoven fabric, which faces away from the belt, is deposited. The last surface contains, for example, almost exclusively bicomponent filaments of spinning orifices 5, and thus possesses a higher hardness and rigidity than the surface produced first. Surfaces of high concentrations of bicomponent filaments have the property of being heat-bondable.

One or more spinneret plates 3 of the kind shown in FIG. 3*b* may be used to create a spun nonwoven fabric. The first outer surface, which will face the collector belt 7, contains predominantly bicomponent filaments produced by spinning orifices 5 shown at the top of the spinneret plate 3 of FIG. 3*b*. Then the inner cross sectional regions of the nonwoven fabric are formed increasingly from the monofilaments from spinning orifices 6 alone as shown in the middle portion of spinneret plate 3 of FIG. 3*b*. A continuous transition through mixtures of both filament types may be achieved by varying the distribution of spinning orifices 5 and 6. Finally, by decreasing the content of the monfilament spinning orifices 6 as shown in the bottom portion of spinneret plate 3 in FIG. 3*b*, the second surface is created which may be made up exclusively, or almost exclusively, for example, of bicomponent filaments.

Figure 2A:
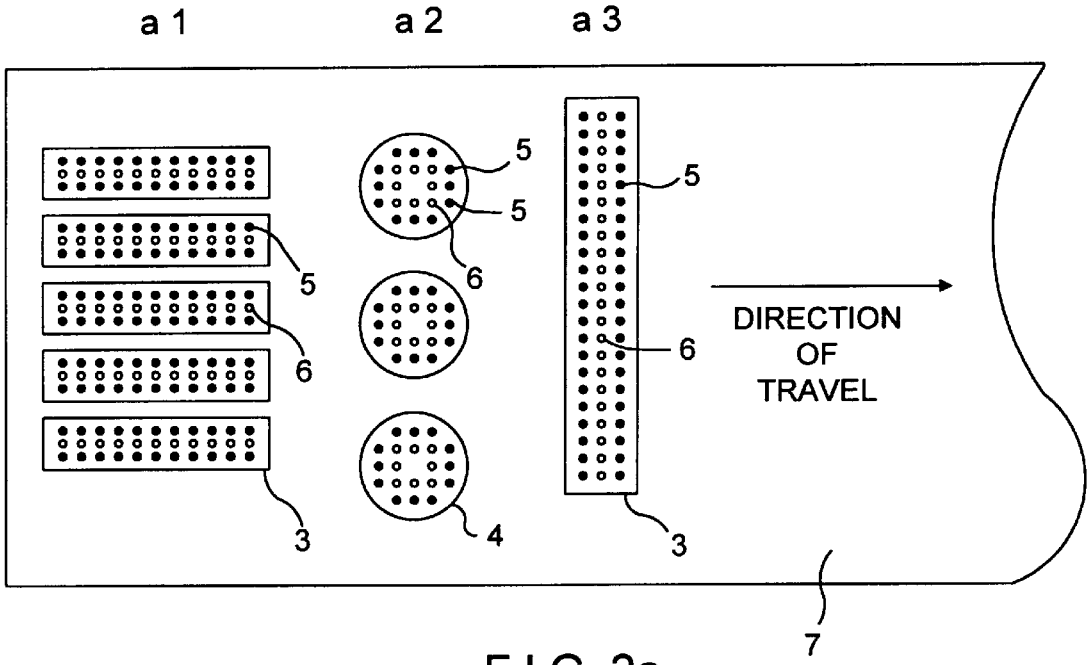
FIGS. 2*a* and 2*b* show various arrangements of the spinning unit with respect to the moving collector belt.
Figure 3D:
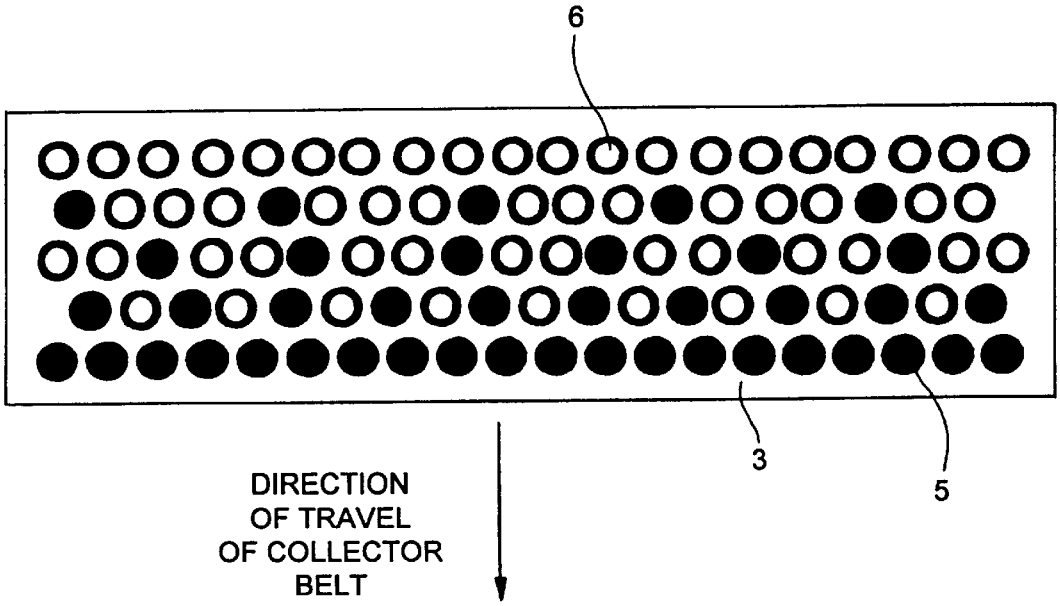

The spinneret plate 3 as shown in FIG. 3*c* may be used to build up a spun nonwoven fabric which contains almost exclusively monofilaments on the surface facing collector belt 7 (as shown at the top of FIG. 3*c*). During further processing, the proportion of bicomponent filaments increases continuously to 100%. The surface of the nonwoven fabric facing opposite the surface on collector belt 7 is thus once again made up substantially or exclusively of monofilaments. FIG. 3d shows an embodiment corresponding to that of FIG. 3*a* except that, in FIG. 3*d*, spinneret plate 3 is oriented perpendicular to the direction of travel of collector belt 7, and its long axis corresponds to the width of the nonwoven fabric being produced. Such an embodiment is also shown in FIG. 2*a*, and is designated a3.

Multiple rectangular spinneret plates 3 or round spinneret disks 4 may be arranged in series with one another. For example, viewed in the direction of travel of collector belt 7, the long axes of the spinneret plates 3 are parallel to the direction of travel. As shown in FIG. 2*a* in the arrangement designated a1, plates 3 are lined up next to each other along an imaginary line perpendicular to the direction of travel. Spinneret disks 4, according to arrangement a2, are similarly arranged with respect to one another on an imaginary line perpendicular to the direction of travel of collector belt 7.

As is known in the art, and may be used in the present invention, pivotingly guiding air flows may be applied between spinneret plates 3 or spinneret disks 4 and the collector belt 7, to guide the filament bundles leaving spinning orifices 5, 6. The guiding air flows may be applied perpendicular to the falling direction of the filaments and perpendicular to the direction of travel of collector belt 7 (i.e. perpendicular to the long axis of spinneret plates 3 in al). Such air flows aid in producing homogeneous nonwoven fabric cross sections perpendicular to the direction of travel of collector belt 7. As the technology of pivotingly guiding air flows is known in the art, they easily can be retrofitted to most existing pieces of apparatus if not yet present.

Figure 2B:
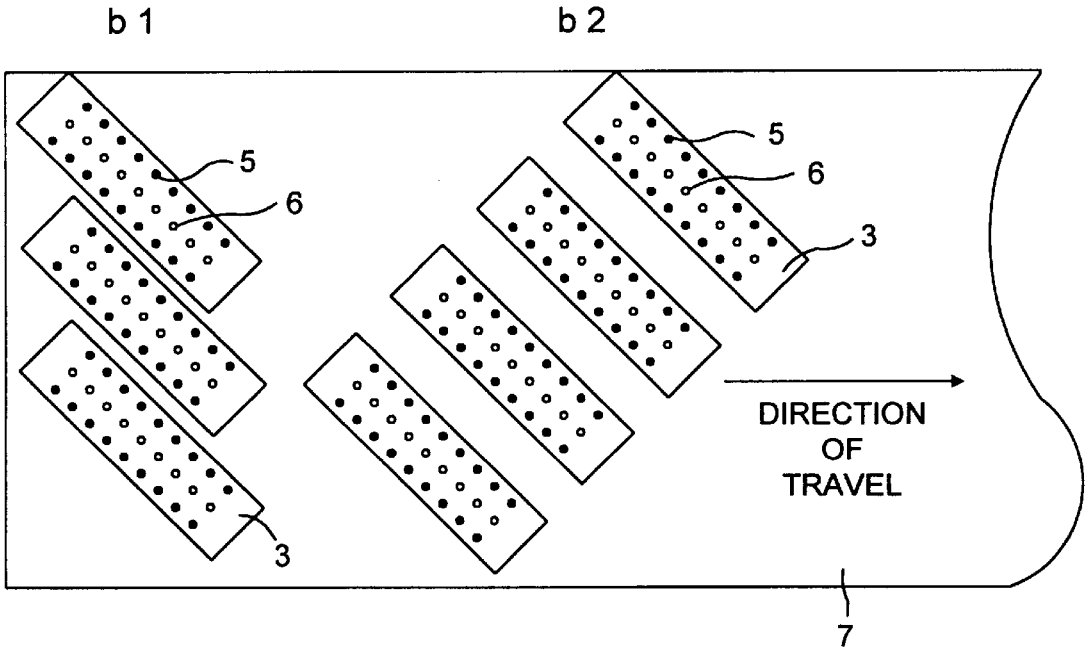

FIG. 2*b* shows several further embodiments of the apparatus. For example, the embodiment designated b1 shows rectangular spinneret plates 3 arranged in staggered fashion obliquely behind one another and oblique with respect to the transport direction of collector belt 7 and parallel to its plane. The filaments leaving spinning orifices 5, 6 in this staggered arrangement may also benefit from pivotingly guiding air flows arranged perpendicular to the filaments' falling direction and perpendicular to the direction of travel of collector belt 7. Such air flow may help produce a consistent fiber mixture within each plane of the nonwoven fabric.

The multiplicity of possible arrangements of spinning devices 3, 4 with respect to collector belt 7, of which FIG. 2 shows only a few advantageous possibilities by way of example, offers the great advantage that the apparatus according to the invention can be incorporated in extremely simple fashion into existing systems for spinning monofilaments. It is necessary simply to change the configuration of spinning orifices 5 and 6, and the preparation and distribution system for the melts, for separate production of filaments made of different materials.

The invention thus can be carried out on existing systems with a minimum of refitting work, no matter whether these systems are designed for spinneret plates or spinneret disks, oriented perpendicular to or in line with the direction of travel of the collector belt, or whether a correspondingly oblique arrangement of spinneret plates is the basis for the concept of the available apparatus.

What is claimed is:

1. An apparatus for manufacturing a spun nonwoven fabric comprising:

a stretching device adapted to receive filaments;

at least one spinneret drive, having a first portion with a first plurality of spinning orifices and a second portion with a second plurality of spinning orifices, and a continuous transition portion having a varying distribution of said first and second plurality of spinning orifices, the at least one spinneret device arranged above the stretching device;

a transport device located beneath the stretching device for receiving the filaments to form the nonwoven fabric, the transport device having a horizontally and linearly moving collector belt defining a transport direction, wherein the first and second plurality of spinning orifices of the at least one spinneret device face toward the collector belt;

wherein the first plurality of spinning orifices discharge a monofilament; and wherein the second plurality of spinning orifices discharge a bicomponent filament, such that when viewed in the transport direction of the collector belt, a projection of the plurality of spinning orifices onto a plane of the collector belt corresponds to the concentration profile of the filaments in a vertical cross section of the nonwoven fabric, and such that, viewed in the transport direction of the collector belt, the filaments which impact the collector belt first are the filaments of a first outward-facing surface of the nonwoven fabric, and wherein, in continuous transition, the filaments which impact the collector belt next are the filaments of inner regions of the nonwoven fabric, and wherein, in continuous transition the filaments which impact the collector belt last are the filaments of a second outward-facing surface of the nonwoven fabric.

2. The apparatus according to claim 1, wherein the at least one spinneret device is a rectangular plate.

3. The apparatus according to claim 1, wherein the at least one spinneret device is a spinneret disk.

4. The apparatus according to claim 1, wherein the at least one spinneret device is a rectangular spinneret plate arranged perpendicular to the transport direction of the collector belt, the rectangular spinneret plate having a length corresponding to a width of the nonwoven fabric being produced.

5. The apparatus according to claim 1, further comprising:

a plurality of spinneret devices, the plurality of spinneret devices arranged in line with one another, the alignment being perpendicular to the transport direction of the collector belt; and air flow generators located between the spinneret devices and the collector belt, the air flow generators pivotally guiding filament bundles leaving the spinning orifices perpendicular to a falling direction of the filament bundles and perpendicular to the transport direction of the collector belt or perpendicular to the long axis of the spinneret devices.

6. The apparatus according to claim 1, further comprising:

multiple rectangular spinneret plates, the multiple rectangular spinneret plates arranged in staggered fashion behind one another, obliquely oriented with respect to the transport direction of the collector belt and parallel to a plane of the transport belt; and air flow generators located between the multiple rectangular spinneret plates and the collector belts, the air flow generators pivotally guiding filament bundles leaving the plurality of spinning orifices perpendicular to a falling direction of the filament bundles and perpendicular to the transport direction of the collector belt or to the long axis of the multiplicity of rectangular spinneret plates.

7. The apparatus according to claim 1, wherein the first portion of the plurality of spinning orifices discharge filaments of the first outward-facing surface of the nonwoven fabric.

8. The apparatus according to claim 1, wherein the second portion of the plurality of spinning orifices discharge filaments of the first outward-facing surface of the nonwoven fabric.

9. The apparatus according to claim 1, wherein the first portion of the plurality of spinning orifices discharge filaments of the inner regions of the nonwoven fabric.

10. The apparatus according to claim 1, wherein the second portion of the plurality of spinning orifices discharge filaments of the inner regions of the nonwoven fabric.

11. The apparatus according to claim 1, wherein the first portion of the plurality of spinning orifices discharge filaments of the second outward-facing surface of the nonwoven fabric.

12. The apparatus according to claim 1, wherein the second portion of the plurality of spinning orifices discharge filaments of the second outward-facing surface of the nonwoven fabric.

* * * * *